United States Patent [19]

Haines

[11] 4,082,329

[45] Apr. 4, 1978

[54] PRIVACY LATCH FOR FOLDING AND SLIDING DOORS

[76] Inventor: Richard K. Haines, 2317 W. Lexington, Elkhart, Ind. 46514

[21] Appl. No.: 728,235

[22] Filed: Sep. 30, 1976

[51] Int. Cl.[2] ..... E05C 3/32

[52] U.S. Cl. ..... 292/202

[58] Field of Search ..... 292/202, 304, 259, DIG. 46, 292/59, 68, 218, 241, 213, 214

[56] References Cited

U.S. PATENT DOCUMENTS

| | | | |
|---|---|---|---|
| 1,200,260 | 10/1916 | Still | 292/218 |
| 1,229,452 | 6/1917 | Heineman | 292/59 X |
| 1,434,325 | 10/1922 | Brown | 292/DIG. 46 |
| 2,211,586 | 8/1940 | Schwarz | 292/304 X |
| 3,026,702 | 3/1962 | Cary | 292/DIG. 46 |
| 3,850,464 | 11/1974 | Bisling et al. | 292/DIG. 38 |

*Primary Examiner*—Richard E. Moore
*Attorney, Agent, or Firm*—Oltsch & Knoblock

[57] ABSTRACT

A latch for sliding and folding doors including confronting plates mounted on the edge of a door and on a door jamb respectively. One plate has an opening and pivotally mounts a retainer or actuator. The other plate has a latching projection receivable in the opening of said first plate and undercut to accommodate reception of a portion of said actuator in one pivoted position thereof to prevent opening of said door.

4 Claims, 15 Drawing Figures

Fig. 1
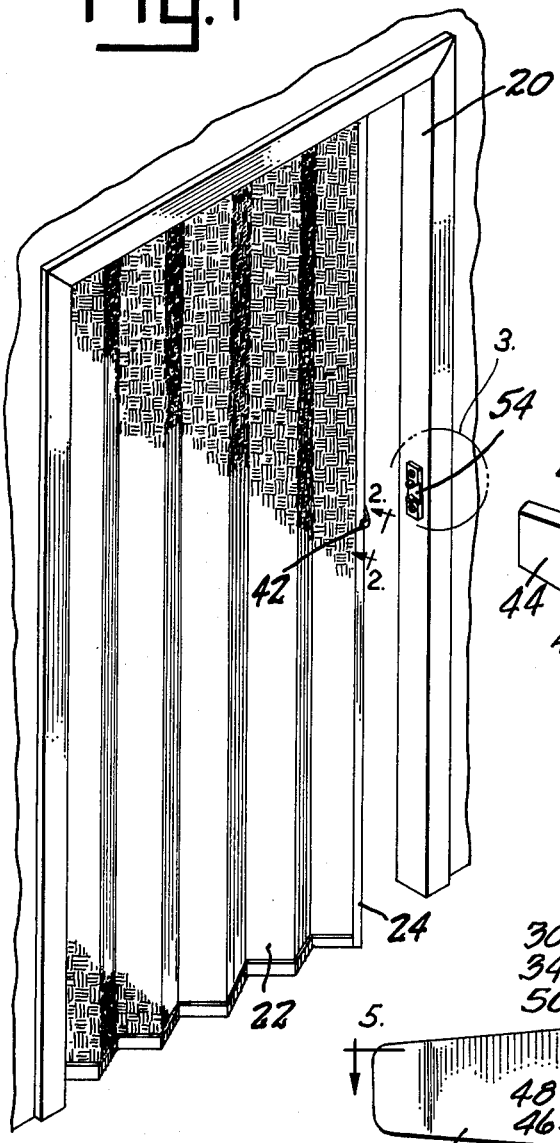
Fig. 2
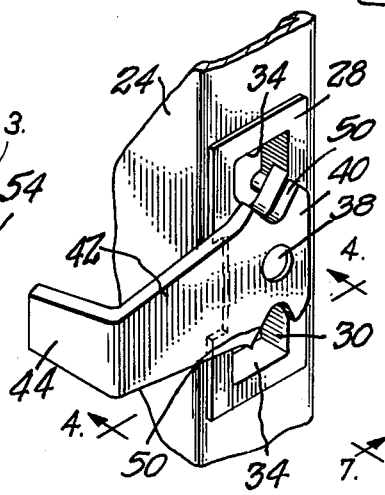
Fig. 3
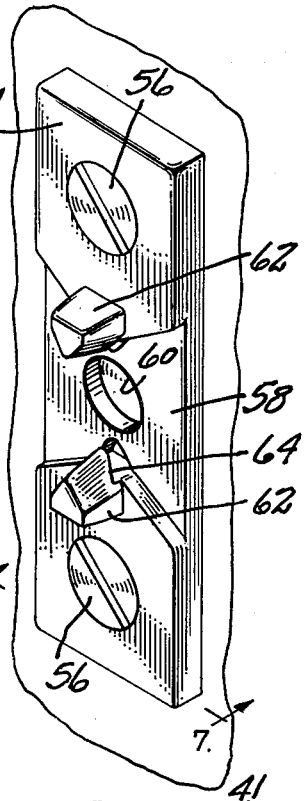
Fig. 4
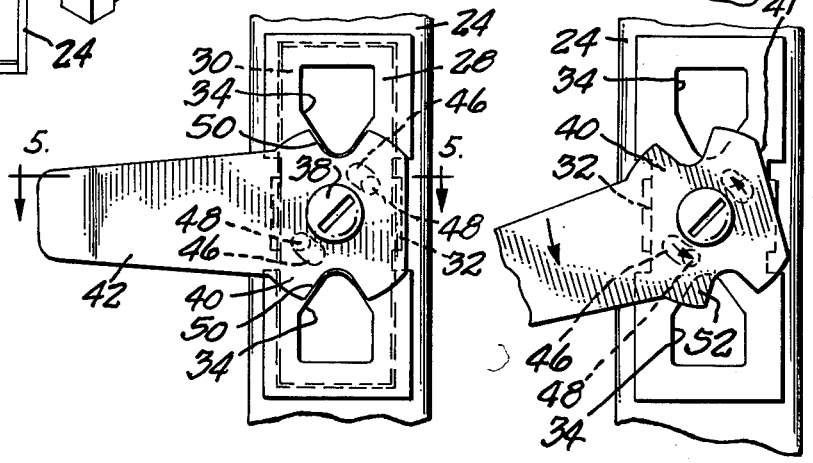
Fig. 5
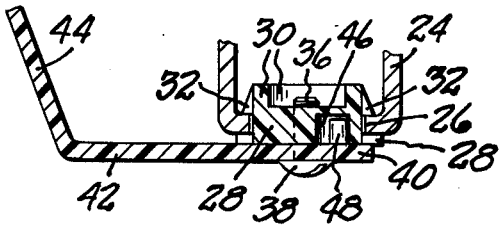
Fig. 6

Fig. 7
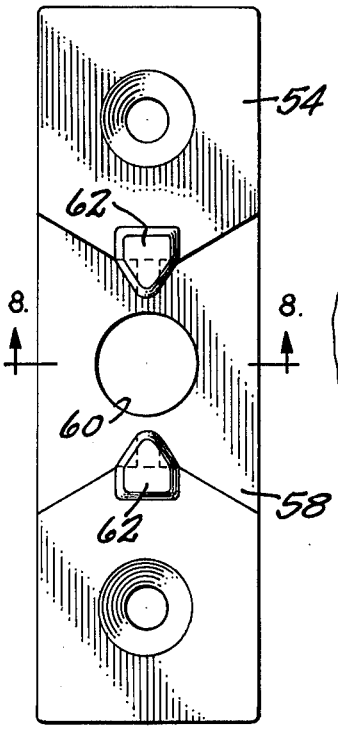
Fig. 9
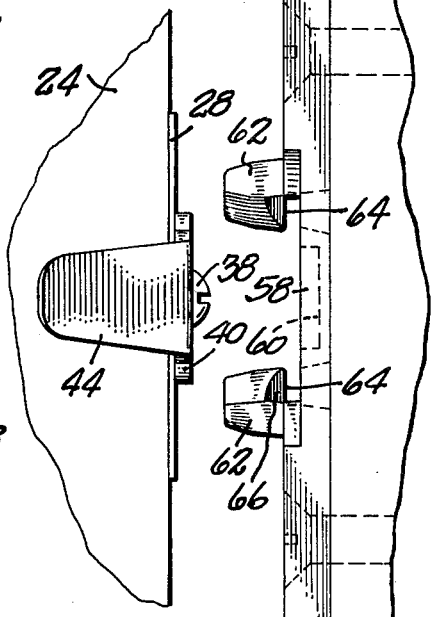
Fig. 10
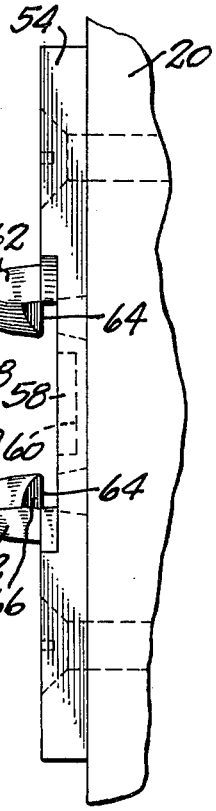
Fig. 11
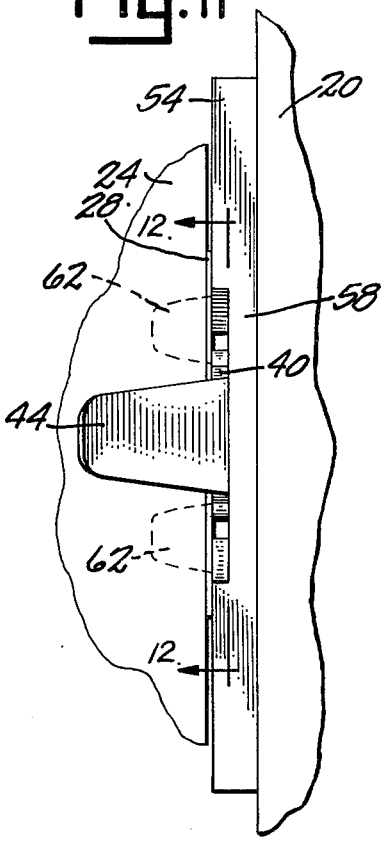
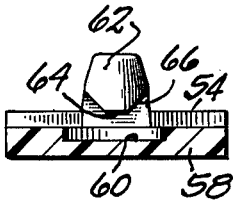
Fig. 8
Fig. 12
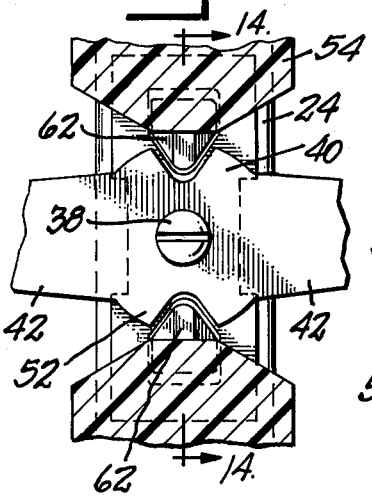
Fig. 13
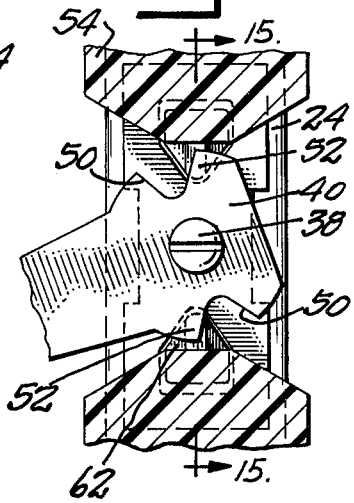
Fig. 14
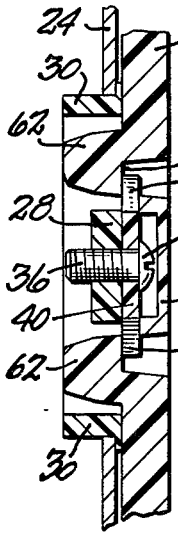
Fig. 15
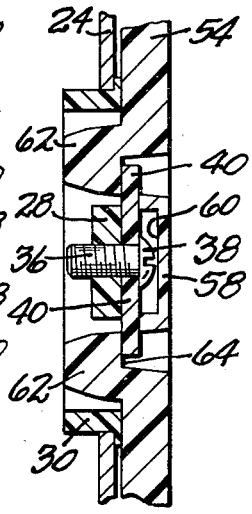

PRIVACY LATCH FOR FOLDING AND SLIDING DOORS

SUMMARY OF THE INVENTION

Folding and sliding doors are widely used in homes, mobile homes and other interior locations to span openings such as closets. These are frequently left ajar carelessly so as to expose to view the contents of a closet or to permit access to the closet by small children, from whom it is desired to protect or hide the closet contents. Also, in mobile homes and other vehicular installations the doors are subject to vibration which may tend to move them from closed to open position during travel. Sliding or folding doors are not usually provided with latches to serve this purpose, and no satisfactory expedient has been available heretofore to meet these problems.

It is the primary object of this invention to provide a novel, simple, inexpensive latch which will meet the requirements of sliding doors.

A further object is to provide a latch which is easy to install and composed of a minimum number of parts, is applicable to doors closing from either right or left, and which can easily be opened in the event of accidental or unintentional latching of a door while a person is located within the area to which access is afforded by the door.

A further object is to provide a device of this character which meets the requirements imposed by law and federal regulation for mobile home construction and safety.

Other objects will be apparent from the following specification.

In the drawings:

FIG. 1 is a perspective view of a folding door in partly closed position illustrating the location of the latch.

FIG. 2 is an enlarged perspective view of the door-mounted part of the latch.

FIG. 3 is an enlarged perspective view of the part of the latch mounted upon the door jamb.

FIG. 4 is a side elevational view of the door-mounted part of the latch as observed in the direction of the arrows 4—4 of FIG. 2.

FIG. 5 is a horizontal sectional view taken on line 5—5 of FIG. 4.

FIG. 6 is an elevational view of the door-mounted part of the latch as seen in the direction of the arrows 4—4 of FIG. 2, with the latch element adjusted to locking position.

FIG. 7 is an elevational view of the door jamb-mounted part of the latch as viewed in the direction of the arrows 7—7 in FIG. 3.

FIG. 8 is a transverse sectional view taken on line 8—8 of FIG. 7.

FIG. 9 is an edge view of the door-mounted part of the latch.

FIG. 10 is an edge view of the jamb-mounted part of the latch.

FIG. 11 is a view illustrating the door in closed position with the parts of the latch in released position.

FIG. 12 is a view taken on line 12—12 of FIG. 11 illustrating the latch in its released position.

FIG. 13 is a view taken on line 12—12 of FIG. 11 illustrating the latch in its locked position.

FIG. 14 is a vertical sectional view taken on line 14—14 of FIG. 12 illustrating the latch in its released position.

FIG. 15 is a vertical sectional view taken on line 15-15 of FIG. 13 illustrating the latch in its closed or locking position.

DESCRIPTION OF THE PREFERRED EMBODIMENTS

Referring to the drawings, the numeral 20 designates a door jamb for a door opening in a wall and the numeral 22 designates a folding door adapted to close the opening defined by the door jamb. The folding door may be of any conventional type which slides in the door opening between open and closed positions and which is provided with a leading edge member 24, such as a metal channel. The door edge member is preferably provided with an opening 26 intermediate its height at which is mounted a latch plate 28 which spans the opening and includes flanges 30 which fit in the door opening 26. Flanges 30 at opposite sides of the plate are preferably provided with cam type latching projections 32 spaced from the inner or rear surface of the face plate a distance substantially equal to the thickness of the material of the door edge member 24 in which opening 26 is formed. The plate 28 and its flange 30 and latching projections 32 are preferably molded from a plastic material, such as nylon, which is normally rigid, but is adapted to yield to permit entry of the latching projections 32 into the opening 26 which is slightly narrower than the spacing between the maximum width portions of the latching projections 32 as seen in FIG. 5. When the latch plate is pressed to the FIG. 5 position in which the plate 28 bears against the door edge member 24 around the opening 26, the latch plate 28 and its flanges 30 return to normal position in which the latching projections 32 engage the inner surface of the door edge member 24 at opposite sides of the opening 26 as seen in FIG. 5.

The latch plate 28 is provided with one opening or a pair of openings 34 adjacent opposite ends thereof as shown, with the innermost portions of said openings preferably of V-shape, as best seen in FIG. 4, said openings 34 being spaced a substantial distance. In the form shown, the latch plate 28 is provided with a central opening equi spaced between the openings 34 adapted to receive the shank 36 of a screw which is threaded therein and provided with an enlarged head 38 which serves to retain an actuator member 40 which is pivoted to the latch plate 28 by means of the screw. Actuator member 40 preferably comprises a plate portion which is elongated to provide a handle portion 42 which projects laterally from plate 28 and preferably includes a bent terminal portion 44 which is spaced laterally from the door edge member 24. If desired, and as illustrated in FIG. 12, the plate may be provided with two projecting handles 42, which project laterally from opposite surfaces of the door edge member and are spaced therefrom.

The latch plate 28 is provided with one or more elongated slots 46, here shown as arcuate, into each of which projects a lug 48 carried by the actuator 40. The interfitting lug 48 and slot 46 serve to limit the extent of the angular pivotal movement of the actuator 40, as between a release position as illustrated in FIGS. 4 and 12 and a latching position as illustrated in FIGS. 6 and 13.

The portion of the actuator member 40 adjacent to the pivot screw 36–38 is preferably of part-circular shape concentric with the pivot screw and of a radius greater than the spacing of openings 34 from the pivot axis of the actuator. This part circular portion is interrupted by opposed notches 50 which register with the innermost or V-shaped parts of the latch plate openings 34 in the release position illustrated in FIGS. 4 and 12, thereby providing retainer portions 52 which project across parts of the openings 34 in the latching position of the parts as illustrated in FIGS. 6 and 13. The actuator 40 may be molded from plastic such as nylon or may be formed of metal, and is of rigid character.

A stationary latch plate 54, which may be molded from plastic material such as nylon or may be formed of metal, is mounted upon the door jamb 20 in a position to cooperate and mate with the movable latch plate 28 which is mounted upon the door. Plate 54 is secured in fixed position on the jamb, as by securing screws 56. Plate 54 has a reduced thickness part 58 located centrally thereof which is interrupted by a central recess 60 aligned with and adapted to receive the screw head 38 in the locked position of the latch as illustrated in FIG. 15. The reduced thickness portion 58 extends across the plate and preferably is widest at its end portions, with its sides converging toward the central part of the plate.

A pair of latching lugs 62 project from the plate 54 at the longitudinal center thereof and are of a shape and size to be received within the apertures 34 of the movable latch plate 28 with slight clearance when the door is closed. The confronting portions of the latching lugs 62 are undercut at 64, the undercut preferably being beveled from the sides to the central portion thereof, as best seen in FIG. 8 at 66.

When the cooperating latch plates 28 and 54 are properly mounted in complementary confronting relation, closing of the door 22 entails reception of the lugs 62 with slight clearance within the apertures 34 of the movable latch plate, which brings the latch plates into substantially abutting relation, as illustrated in FIGS. 11, 14 and 15, assuming that the actuator 40 is in the open position illustrated in FIGS. 4, 12 and 14. This permits the lugs 62 to project inwardly beyond the innermost face of the actuator 40. Thereupon, pivoting of the actuator 40 to the position illustrated in FIGS. 6 and 13, which is accommodated by the shape of the reduced thickness part 58 of the stationary latch plate 54, results in movement of the retainer portions 52 of the actuator into the undercut 64 of the lugs 62 as illustrated in FIGS. 6, 13 and 15 at which the latch is in its effective latching position retaining the door against movement to open position. The extent of pivotal movement of the actuator 40 is determined by the length of the slot 46 receiving the lug 48 of the actuator, or by the side edges of the reduced part 58 of the plate, or both. The bevel surfaces 66 of the latching projections 62 permit wedging of the door to fully closed position.

It will be apparent that the device is universal in application and may be installed with equal facility upon doors which close by movement to the right and those which close by movement to the left. Thus, in a unit having a single handle 42, the mounting of the movable latch plate 28 upon the door edge member 24 may be inverted. This also accommodates mounting on the door with the actuator handle projecting at either side of the door as elected. No care in selecting the mounted position of the movable latch plate 28 on the door is required in instances where the actuator 40 is provided with two handles 42 projecting beyond the opposite sides of the door. Doors provided with such double handles can obviously be latched and released by manipulation of the handles at the two sides of the door.

The latch can be manipulated from locked to release position or vice versa from both sides. In the case of an actuator having only one handle portion is illustrated in FIG. 2 the edge 41 of the actuator is positioned close to the edge of the door frame 24 so that any member insertable between the door and the jamb can be used to press the actuator from the latching position shown in FIG. 6 to the release position shown in FIG. 4.

While the plates are preferably mounted as above described, it will be obvious that plate 28 may be mounted on the door jamb and plate 54 may be mounted on the door.

While the preferred embodiments of the invention have been illustrated and described, it will be understood that changes in the construction may be made within the scope of the appended claims without departing from the spirit of the invention.

What I claim is:

1. A latch for sliding and folding doors comprising a pair of latch plates mounted in confronting relation on a door jamb and a door respectively, one of said plates having an opening, an actuator pivoted to and in face contact with said first named plate adjacent said opening and including a portion overlying said opening in one pivoted position, said plate being clear of said opening in a second pivoted position, the other plate having a latching projection fitting in the opening of said first named plate when said door is closed and said actuator is in a pivoted position clear of said first plate opening, said latching projection being undercut to receive a portion of said actuator in said first pivoted position when said door is closed, said second named plate having a thick portion and a reduced thickness portion, said reduced thickness portion receiving said actuator to accommodate contact of said first plate with the thick portion of said second plate when said door is closed.

2. A latch as defined in claim 1, wherein said first plate has a pair of spaced openings and said actuator is pivoted between said openings and has two opposed notches, said second plate having a pair of undercut latching projections receivable in the openings of said first plate and receiving said actuator portions.

3. A latch as defined in claim 1, wherein said first plate includes a projecting flange receivable in a door opening and having a snap locking portion engaging said door at the margin of said door opening.

4. A latch as defined in claim 1, wherein the undercut of said latching projection is beveled to accommodate wedging action with said actuator to wedge said door to fully closed position as said actuator is pivoted to enter said undercut.

* * * * *